United States Patent [19]

Chaise

[11] Patent Number: 4,982,452

[45] Date of Patent: Jan. 8, 1991

[54] SAFETY HELMET PROVIDED WITH AN INTERLOCK SIGNAL

[76] Inventor: Francois Chaise, Grandvaux, Palinges, F-71430, France

[21] Appl. No.: 269,736

[22] PCT Filed: Jan. 8, 1988

[86] PCT No.: PCT/FR88/00017

§ 371 Date: Sep. 29, 1988

§ 102(e) Date: Sep. 29, 1988

[87] PCT Pub. No.: WO88/05637

PCT Pub. Date: Aug. 11, 1988

[30] Foreign Application Priority Data

Jan. 29, 1987 [FR] France ..... 87 01221

[51] Int. Cl.[5] ..... A42B 7/00; A42B 3/02

[52] U.S. Cl. ..... 2/421; 2/410

[58] Field of Search ..... 2/2.1 A, 5, 6, 410, 2/414, 421, 425

[56] References Cited

U.S. PATENT DOCUMENTS

| | | | |
|---|---|---|---|
| 4,109,105 | 8/1978 | Von Statten, Jr. | 2/425 X |
| 4,581,774 | 4/1986 | Chaise | 2/421 |
| 4,719,462 | 1/1988 | Hawkins | 2/6 X |

FOREIGN PATENT DOCUMENTS

| | | | |
|---|---|---|---|
| 185922 | 7/1986 | European Pat. Off. | 2/410 |
| 2603435 | 8/1977 | Fed. Rep. of Germany . | |
| 2619947 | 11/1977 | Fed. Rep. of Germany . | |
| 3032371 | 3/1982 | Fed. Rep. of Germany . | |
| 221756 | 7/1974 | France . | |
| 2590128 | 5/1987 | France | 2/425 |
| WO86-01379 | 3/1986 | PCT Int'l Appl. . | |
| WO88/05637 | 8/1988 | PCT Int'l Appl. . | |

*Primary Examiner*—Wm. Carter Reynolds

*Attorney, Agent, or Firm*—Sandler, Greenblum & Bernstein

[57] ABSTRACT

Helmet provided with a signal ensuring the user that the locking of the retention system is totally achieved. In the case represented, the signal is a sound source (9) which is powered by a battery (8). Plate (2) of chin strap (7) is secured to shell (1) and is also part of the power supply circuit for signal (9). The circuit is activated when a force exerted against textile tape (4) by the user's head is sufficient to establish contact between a flexible blade (19) and plate (2). The signal stops emitting when the force disappears, upon removal of the helmet or when the chin strap (7) is sufficiently tensioned towards the inside of the helmet and is therefore properly fastened to separate flexible blade (6) from its contact point on extension (13) of plate (2). The device is particularly adapted to helmets for motorcyclists.

10 Claims, 5 Drawing Sheets

SAFETY HELMET PROVIDED WITH AN INTERLOCK SIGNAL

The present invention is directed to a safety helmet having a device which enables the user of the helmet to make sure that the interlock of a fastening system, was properly executed.

In the present state of technology, safety helmets are provided with two different fastening systems; (a) a chin strap; or (b) without a chin strap, in which flexible or rigid skirts are bound to the shell.

Very often, the chin strap system, when it exists, is used in a wrong way; that is, the chin strap is not sufficiently tightened, or due to thoughtlessness of the user, not used at all. As for helmets that do not employ a chin strap, the skirts are inevitably closed, but they may be locked in a wrong way, either due to a failure of the inlocking system, or owing to the clumisness of the user. In such a case, the user is unaware of the fact that the helmet is not properly secured.

According to the present invention, a helmet is provided with a visual, sonorous or tactile signal that enables the user to know whether the helmet is properly fastened.

In the case of a chin strap fastening system, the preferred embodiment comprises a sonorous signal that stops when the chin strap is properly fastened and tightened. In such a case, the signal system is preferably electrical or electronic, such as a sonorous source that is included in the helmet at the level of at least one ear of the user. One of the connection points of the chin strap on the shell is provided with a switch authorizing the opening of the circuit, and consequently the breaking of the working of the sonorous source only when the chin strap meets with a sufficient pulling towards the interior of the helmet so as to separate the electric contacts. Inversely, according to a second embodiment, the signal goes into action only when the chin strap has been correctly fastened. In such a case, the pulling on the chin strap towards the interior of the helmet leads to the joining of the contacts of the switch of the electric circuit supplying the alarm system. In order to avoid the permanent operation of the alarm when the helmet is properly secured, the alarm device is deactivated by a delay system of a known type, which causes the interruption of the signal after a predetermined period of time, such as after one minute. In another embodiment, the sonorous source, such as an electronic "bip-bip", is replaced by a visual signal, such as an electroluminescent diode, small bulb, liquid crystal display, etc., that is placed in the visual field of the user.

In the case of a helmet having a fastening system without a chin strap, which is provided with an electric, mechanical or magnetic locking system, or a helmet having a chin strap with a fast locking system, the preferential execution is a system with a locking signal which will only release when the locking operation is correct. According to such an embodiment, the signal is electric or electronic, sonorous or visual and, the contacts enabling the closing of the circuit are mounted on two cooperating parts of each locking part of the helmet. These locking parts are chosen so as to be in touch and close the circuit only when the locking operation is completely executed. A delay system controls the interruption of the signal after a predetermined emission time.

The electric or electronic embodiments of the device, according to the above described invention for helmets of the chin strap type, as well as for those of the type without a chin strap, can be improved by a device that prevents the signal from operating when the helmet is not used. For that purpose, either a main switch is operated by the user, or preferably, an automatic device is provided that is able to activate the signal circuit only when the helmet is placed on the head of the user and is deactivated each time the helmet is removed from the head of the user.

According to one feature of such an embodiment, a device comprises an electronic sensor, i.e., either an electronic eye reacting sensor; a detector reacting to the breathing of the user; a detector that reacts to the presence of the head in the helmet; a detector reacting to the whistling of the user; a heat detector reacting to the heat emitted by the head of the user; a detector reacting to the voice of the user; or, any other type of detector mounted in the interior of the helmet.

According to a second feature of the invention, such a device comprises an electronic switch mounted on the internal upholstery of the helmet. Such a switch reacts to the pressure of the user's head against the upholstery during the action of setting or removing the helmet from the user's head.

According to a third feature of the invention, such a device comprises a set of electric contacts, one of them being mounted on the helmet while the other, mobile at the free end of an elastic element, such as a metallic or plastic blade backing on a part of the upholstery, is pressed by the head of the user.

A favorite kind of achievement of this last type of automatic electric contact is one using a generally elastic fabric tape, at least for a part of its length, fixed at one end to the surface of a comfort covering of the helmet or any other point of the helmet. It circulates in its interior like a tightened string above a curved area of the upholstery's surface, while its other end is affixed to a mobile contact. This one, kept at distance from the fixed contact, is mounted on an elastic system, such as a flexible blade, so that the user, when inserting his head into the helmet, acts on the tape with a sufficient pressure to cause a movement of the mobile contact, enabling it to touch the fixed contact, thereby closing the electric circuit to enable the operation of the signal. Generally, one or more small batteries are placed in spacings at the lower part of the shell or of the internal padding of the helmet end supply the necessary electrical power.

According to another feature of the invention, the helmet includes a mechanical control, preferably composed of a visual signal, formed for instance, by a small colored piston sliding inside a small bell, the part of which is viewable by the user being made of transparent plastic.

With its non-visible end, the small piston is linked to a flexible transmission, such as a small metallic cable, rod or flexible blade, and so on, itself conducted inside a sheath against the shell of the helmet and fixed by its other end on a second small sliding piston, one of the mobile parts of the locking system leaning against it.

According to this embodiment, when the helmet is completely and correctly locked, the mobile piece transmits its movement to the receiver piston, the movement of which, transmitted by the flexible linking element, reflects on the small colored piston, thus provoking its appearance or disappearance inside the small bell.

The flexible linking element possesses, as the case may be, a "receiver" end that is directly fixed on the mobile piece of the lock, or can be supported by a column of incompressible fluid inside a tight sheath. In all these cases, it's to be desired that a recoil device, for instance an elastic system, such as a spring, be provided, in order to enable the reverse motion of the colored signal, as soon as the unblocking happens. This system can also be fitted on a helmet having a chin strap by fixing the "receiver" end of the linking element on the chin strap. In this case, one must plan for the doubling of the strap, only on one part of its length, between its connection point on the shell and its connection point at the linking element, by means of an elastic system, such as elastic textile tape. The unused chin strap is locally folded up, forming a small loop, which when used, is sufficiently tightened in order to overcome the resistance of the elastic system, communicating adequate motion to the linking element and thus to the colored signal. It is also possible to replace the colored visual signal by one of the electrical or electronic signals previously described, such as an electroluminescent diode or a sonorous source. In such a case, the flexible linking element acts with its end, normally fastened to the signal, on a switch that is able to open and close the signal circuit.

Regarding helmets of the type that do not have chin straps, a simple signal, used alone or in combination to those already described, can be formed by a set of elastic devices, such as springs, which keep the locking system in the open position, on the one hand, and the fastening elements themselves, (i.e., flexible or rigid skirts) on the other hand, as long as the closing is not complete and the locking total. Thus, in case the user improperly performs the locking operation, the user will be informed of such by the lack of a proper pressure of the fastening element against his neck and lower part of his face, causing the activation of a tactile signal.

In one particular embodiment, the sonorous or luminous source which emits a signal that is directly discernible to the user, as described in the various different electric and electronic variations described earlier, is replaced by an electro-magnetic sonorous or luminous wave generator that emits a signal (called a "primary" signal) in a spectrum that is not directly discernible a user. In this particular type of design, a "receiver", which is activated by the "primary" signal, is able to activate a second signal (called a "secondary" signal) which is discernible to the user.

According to one version, the "receiver" has a sonorous or luminous source which emits the "secondary" signal which is supplied with electric power from a battery. The whole electronic circuit necessary for the coordinated linking and working of these different elements are contained, for instance, in a separate case, badge, key-ring, or box that is associated with the user, fixed to the user, placed on his vehicle or is a part of his vehicle.

According to a second version, the "receiver" and the "secondary" signal source which it controls are mounted on the electrical circuit of the vehicle with which the helmet is generally used.

According to a third version of the invention, the "receiver" is mounted on the vehicle with which the helmet is generally used. When it is activated by the "primary" signal, the "receiver" controls the opening and/or closing of an electrical circuit of the vehicle. The "secondary" signal, discernible to the user, is the operating or non-operating of at least one of the components of the utilized vehicle, such as a sonorous warning signal, hazard warning lights, or the vehicle starter. In these versions of the invention, the "receiver" and its accessories can be originally mounted on the vehicle by the manufacturer or separately sold as an adaptable accessory. In all cases, in the helmet, the circuit of the primary signal generator, in addition to at least one of the previously described devices of submission to the fastening system may comprise a manual switch, which allows the user to repeat the primary signal emission in case it would not have been picked up by the "receiver". Such a switch should work only if the quality of the fastening system meets the requirements necessary to the working of the signal.

All these versions are only quoted as illustrations and do not limit the scope of the invention. Any new versions which are of the same spirit as those described herein, that is to say, a helmet equipped with a signal whose working is submitted to one of the fastening system, would not go beyond the scope of the invention. It is notably noticeable that a helmet equipped with more than one lock signal would not go beyond the scope of the invention, whether they are the concern of the same versions or not or a helmet equipped with some of the fastening systems, notably without a chin strap, which are not described in the present document to which a signal in accordance with the object of the present invention would be fitted. All the same, the examples herein are described only as an illustration and are not at all restrictive, in reference to the annexed drawings.

Figure 1:
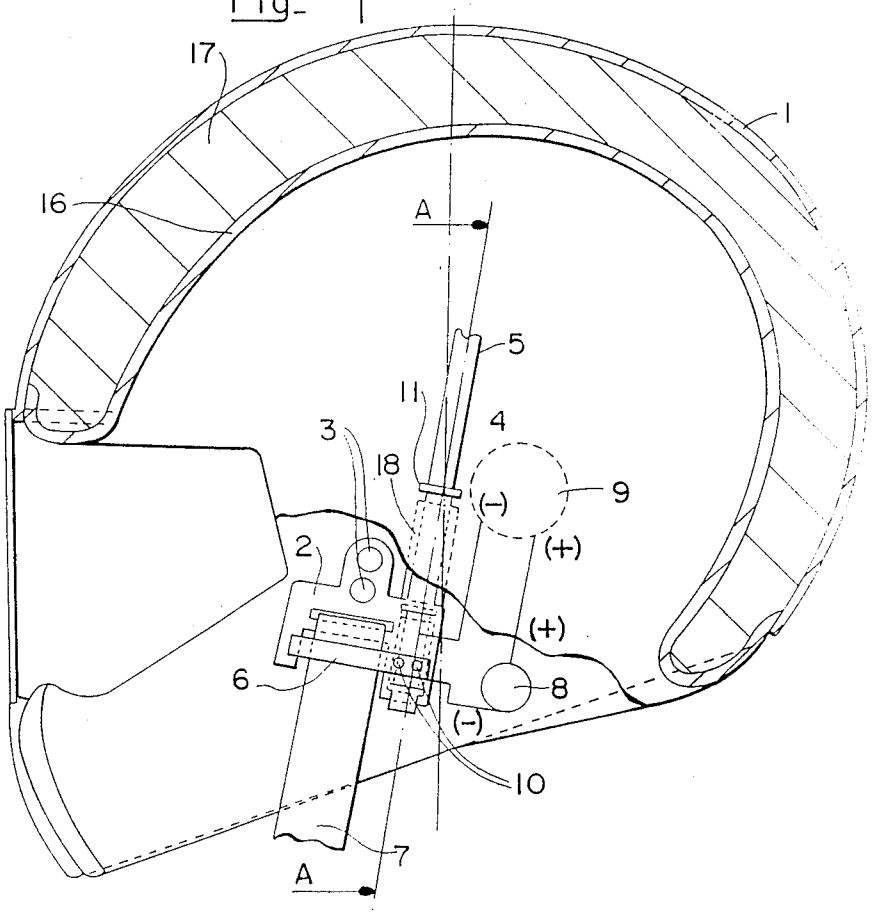
FIG. 1 is a longitudinal section of a helmet with a chin strap fitted with a sonorous signal.
Figure 2:
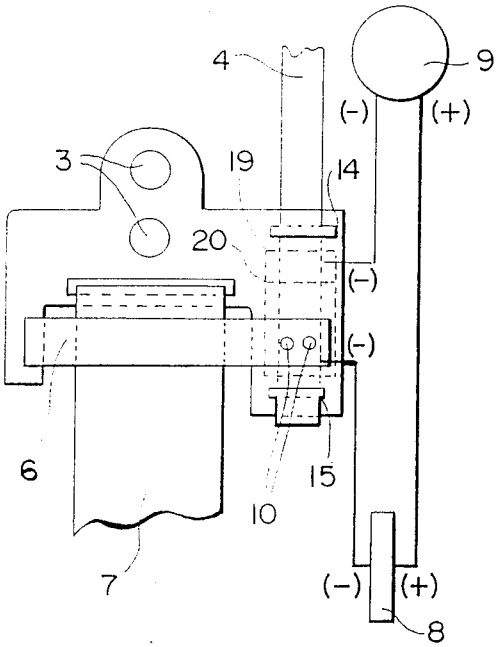
FIG. 2 is an enlarged view of the device of the present invention of the helmet of FIG. 1.
Figure 3:
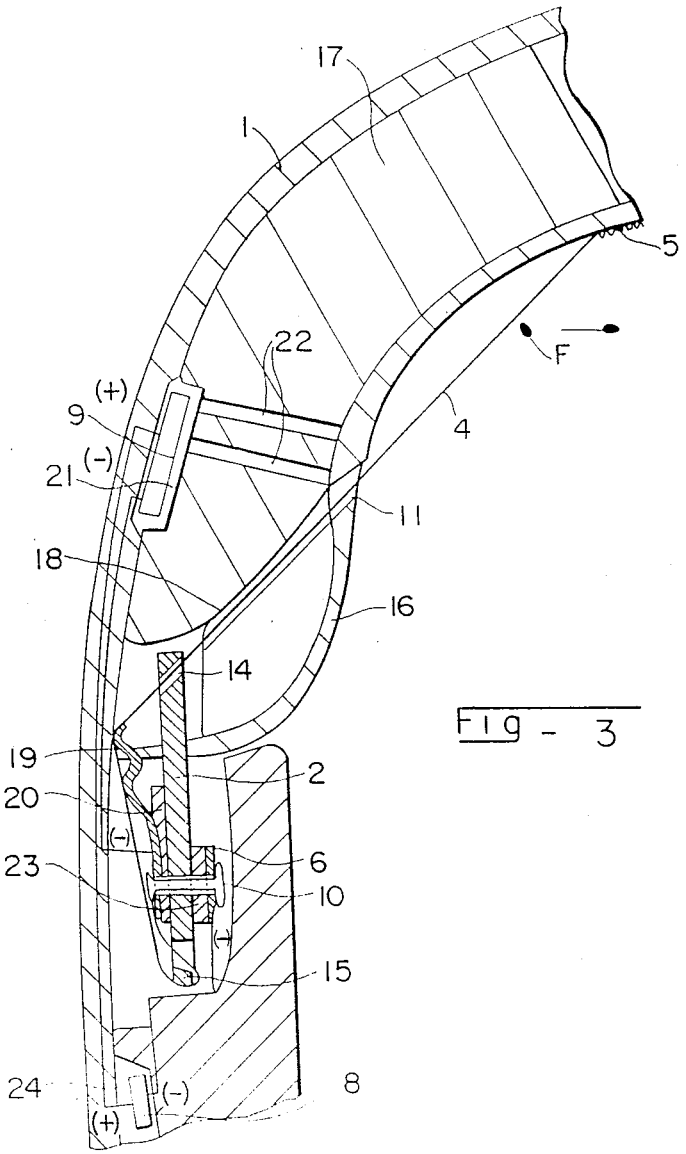
FIG. 3 is a partial enlarged section according to III—III of the helmet of FIG. 1.

A helmet, shown in FIG. 1, has a chin strap 7 fitted with a sonorous source, the operation of which begins as soon as the helmet is placed on the head of the user and which stops emitting a signal as soon as the user has correctly buckled and tightened his chin strap. At least one of the two ends of the chin strap 7 is linked to shell 1 of the helmet through a steel plate 2 that is fastened on an inner boss of the shell 1 by means of rivets 3.

Textile tape 4 is also fastened to the plate 2, at least a part of the tape 4 comprising elastic textile tape. Tape 4 has an end that is formed into a loop that is sewn together, after the end has been placed through an aperture 15 in the plate 2. The remaining end of the tape 4 rises behind the plate 2 up to the top of the helmet, passing through a slot 14 in plate 2, extending under upholstery 16 inside the helmet on an inclined plane 18 hollowed out inside internal padding 17 of the helmet, before exiting the upholstery 16 through a slot 11 to be connected at point 5. Located between the textile tape 4 and plate 2 is a flexible metallic blade 19 that is fastened to the plate 2 with two plastic rivets 10 which keep tape 4 against shell 1 so there is no direct contact with plate 2, which is separated by an insulating plate 20. A conducting wire is fastened to plate 19 which joins the negative terminal of a sonorous emitter 9, situated in a countersink 21 of the shell 1 opposite one of the user's ear. Small channels 22 are drilled through the internal padding of the helmet 7 to enable the user to hear the sonorous signal. The face of the plate 2 which is turned to the interior of the helmet also carries a flexible metallic blade 6 which is separated from the plate 2 by an insulating plate 23 and which is secured to the plate 2 by plastic rivets 10. The blade 6 passes in front of the chin strap 7 underneath the fixing level of this chin strap around the aperture 16 of the plate 2. A free extremity 13 of the flexible blade 6 takes its bearing on a punctual prolongation 12 of the plate 2. A conducting wire is fastened to the blade 6 which is connected to the negative pole of battery 8 located in countersink 24 of the shell 1. Another conducting wire connects the positive pole of the battery to the sonorous emitter. When the helmet is not worn, the flexibility of the blade 19 keeps it away from plate 2 so that the electric circuit is open and the sonorous source is inoperative. When the user puts the helmet on, his head bears against tape 4 in the segment where tape 4 is secured to point 5, so that a force F is exerted on the tape 4. The two extremities of the tape 4 are fixed in relation to the helmet with which it is connected at points 5 and 15. Therefore, the force F acting on the flexible blade 19 tries to surmount its elasticity to bring its free extremity into touch with the surface of the plate 2. This action closes the electrical circuit so that current passes through plate 2 and the sonorous source begins to operate. In order to stop the signal, the helmet has to be taken off, or the chin strap 7 must be maintained sufficiently tight towards the interior of the helmet, so that, when taking its bearing on the flexible blade 6, it succeds in surmounting the resistance and to separate the free extremity 13 of prolongation 12 of plate 2, producing the opening of the electric circuit and the interruption of the sonorous signal. Besides the fact that it obliges the user to make a good use of his chin strap 7, such a system presents the advantage of drawing attention to an ill-timed loosening of the chin strap 7.

Figure 4:
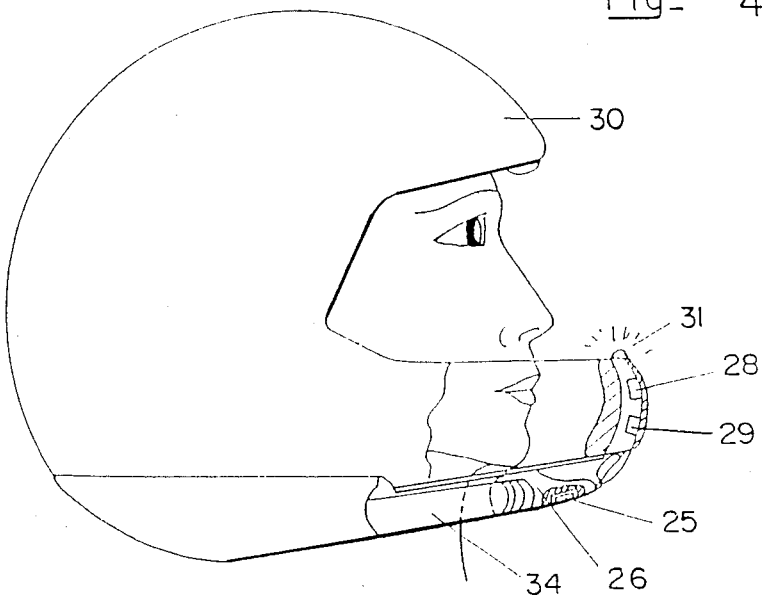
FIG. 4 is a lateral section of a helmet without a chin strap which is fitted with a sonorous signal.
Figure 5:
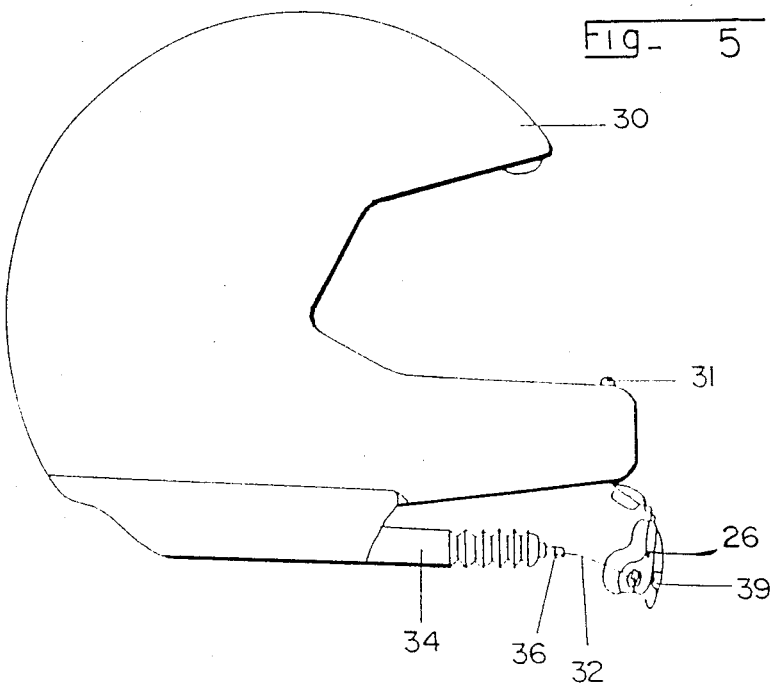
FIG. 5 illustrates the helmet of FIG. 4 in an open position.
Figures 6A, 6B, 6C, 6D:
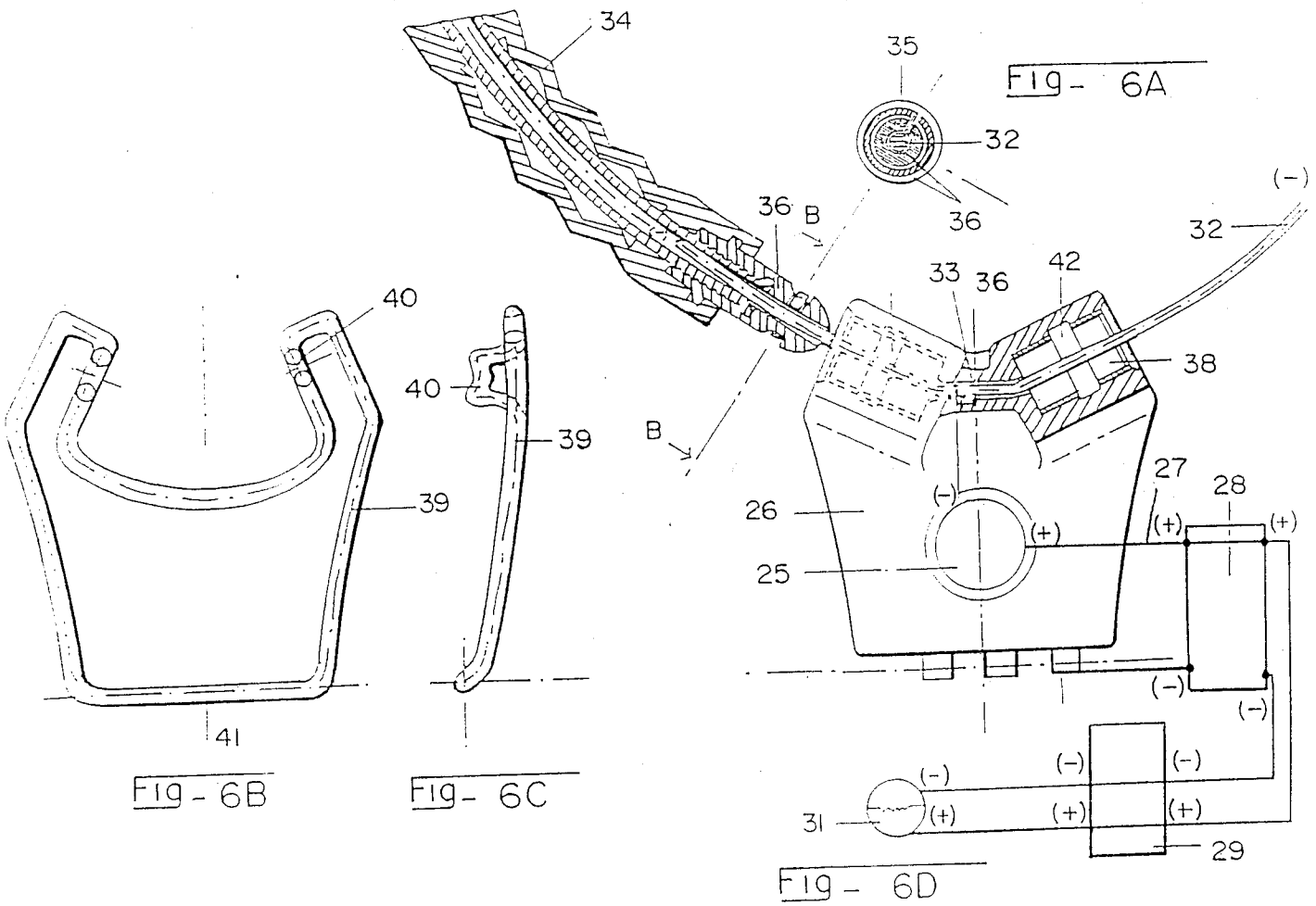
FIGS. 6A–6D are exploded views of partial sections of a fastening means used in the helmet of FIG. 4.

The helmet of FIGS. 4 and 5 represents one of the possible types of helmets that do not have a chin strap. This one, chosen arbitrarily as a non-limitative example, has been described in European Patent No. 0072767, which corresponds to U.S. Pat. No. 4,581,774. There, it is fitted with a visual signal, the working of which happens only when the helmet is correctly locked on the user's head. This system is fed by a battery 25 housed in articulated part 26 of the helmet bearing the locking system. The positive pole of the battery 25 is directly connected to the positive pole of an electronic noise detector 28 via a conducting wire 27 situated in the internal surface of a "maxillary protection" part of the shell 30, to the positive terminal of an electonic retarder 29 and finally to the positive terminal of the electroluminescent diode 31 that is fastened on the lower edge of the shell 30 at a visual field that is visible to the user. The negative terminal of the battery 25 is connected to a flexible and metallic guide 32 at a boring level 33 of part 26 via a second conducting wire. The free extremity of the flexible guide 32 is introduced into a tubular collar of fastening 34, the flexible guide 32 being permanently in touch with the curved extremity of a flexible metallic ring 35 overlapping the groove of the locking elements, which comprise nonconductor synthetic matters 36. Hinge 37 of part 26 is connected by a conducting wire to the negative pole of the noise detector 28, retarder 29 and the electroluminescent diode 31. The noise detector 28 senses whether the helmet is placed on user's head by sensing noise, such as the wearer's breathing. If the noise detector 28 senses a desired sound, such as the sound of one breathing or speaking, the system knowns that the user has placed the helmet on his head. When the helmet is not properly locked, there is no connection between the negative pole of the battery 25 and the hinge 37. Thus, the visual signal remains off, even when the user has the helmet on his head. On the other had, when the helmet is locked, conductor 36, introduced at the bottom of housing 38 of part 26, engages locking piece 39, which is made of steel wire and which has a rectilinear portion 41 which is also the hinge pin 37 that is kept tight against the external face of part 26 by a flexible system, i.e., kickover spring, not represented, that can enter an engage ring 35, owing to tongues 40 passing through holes 42 of piece 26 and provide the locking of the helmet. Current then flows through loop 39, to the negative terminal of the battery 25 through the hinge 37. The signaling system is now active and can work if: (a) the noise detector 28 is activated by the user, and (b) the user enables the total closing of the electric circuit. The electroluminescent diode 31 lights for a predetermined period, such as approximately one minute, at which time retarder 29 will deactivate the system so as to extinguish the electroluminescent diode 31.

Figure 7:
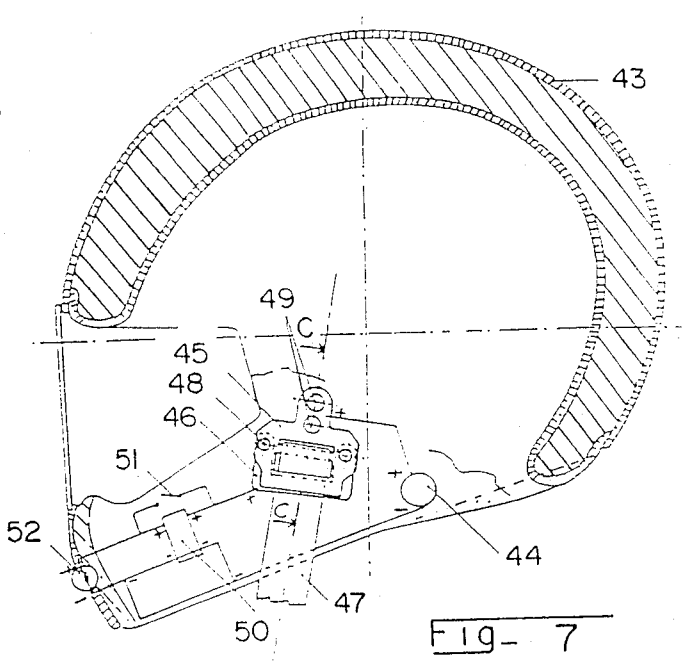
FIG. 7 is a longitudinal schematic section of a helmet with a chin strap fitted with an infrared signal.
Figure 8:
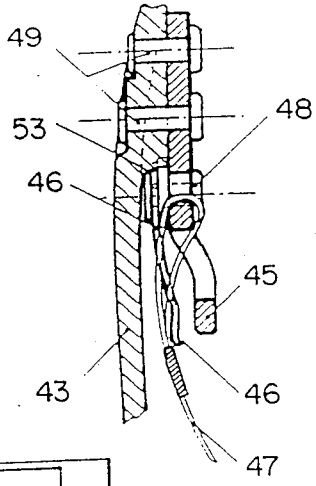
FIG. 8 is a partial enlarged section, according to VIII—VIII of the helmet pictured in FIG. 7.

FIG. 7 pictures a helmet with a chin strap 47 fitted with another type of interlocking signal in which an infra-red ray is emitted towards the external part of the helmet from a generator, such as a diode 52. This diode is fed by a battery 44, in which the positive terminal is linked to metallic loop 45 of the chin strap 47 that is affixed to the shell 43. Elastic metallic blade 46 is fastened on the loop 45 by non-conducting rivets 48 and isolated from this loop by two non-conducting discs 53. The chin strap 47, passing between the shell 43 and the blade 46, is enabled when it is pulled towards the interior of the helmet, indicating that the helmet is correctly locked. In this case, the circuit of the diode 52 is turned on by the engagement of blade 46 with loop 45. The diode 52, fed by an electronic circuit 50 having a retarder system, emits infra-red rays (which is a primary signal) towards the exterior of the helmet for a predetermined period of time. This signal is picked up by a semiconductor element, such as a photo-transistor located on a separate receiver 54, to issue a secondary signal that is discernible to the user.

If the infra-red rays are directed in a wrong direction during the emission period, the infra-red beam does not reach receiver. Therefore, switch 51 is manually operated by the user to supply electrical power to the diode 52. This is accomplished by having the user tightly lock the chin strap 49, creating a new infra-red rays emission which will last as long as pressure is exerted on switch 51.

Figure 9:
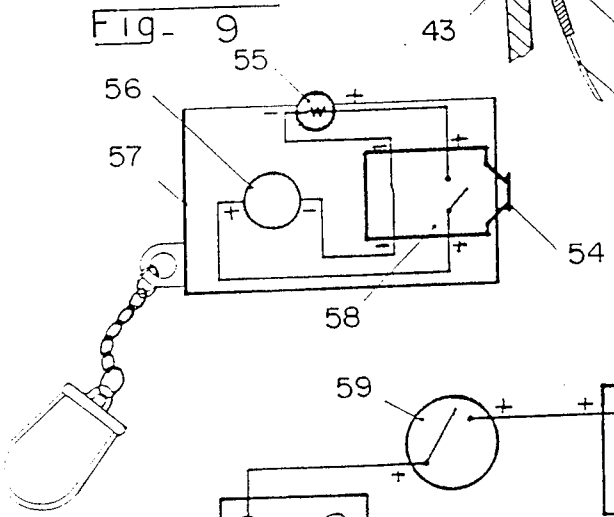
FIG. 9 is a diagrammatic representation of a separate receiver, cooperating with the helmet of FIG. 7.

FIG. 9 schematically pictures a possible receiver mode that is associated with the helmet of FIG. 7. In addition to the receiver element 54, keyring 57 contains an electroluminescent diode 55 that is able to emit a secondary signal that is discernible to the user in a spectrum visible to man. These elements are fed by a battery 56. An electronic circuit 58, included in the case 57, acts as a retarder system.

When the chin strap 47 is correctly fastened, element 54 turns on diode 55. Therefore, the secondary signal is emitted for a predetermined period of time, this signal being discernible to the user, when it is activated by the infra-red ray primary signal coming from diode 52.

Figure 10:
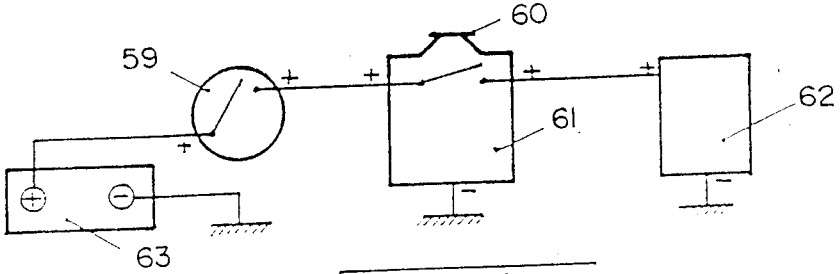
FIG. 10 is a diagrammatic representation of a receiver associated with a vehicle cooperating with the helmet of FIG. 7.

FIG. 10 illustrates another type of secondary signal that is discernible to the user. In this example, a helmet is associated with a vehicle, such as a motorcycle. Semiconductor "receiver" element 60 is mounted proximate starter 62 of the motorcycle, and orientated in such a way that it can pick up the primary signal emitted by diode 52 when the helmet user is on the vehicle. Receiver element 60, able to control the opening or closing of the circuit on which it is mounted, can only work when it is placed under tension. Consequently, the user cannot start his vehicle unless two conductions are met:

first, the motorbike electrical circuit closing has to be made at key-contact level 59; and second, the phototransistor 60 has to be activated by the infra-red rays coming from the diode 52. The phototransistor 60 then controls the electrical circuit, activating the starter 62 of the motorbike so that the vehicle can start. In the pictured version, the electrical circuit 61, associated with receiver element 60, can be conceived in such a way that the circuit of the starter 62 stays closed after the infra-red rays emitted from the diode have stopped.

To enable the use of this helmet by a motorcycle passenger, it is possible and desirable to make a helmet that has a sonorous or luminous signal that is discernible to the user, and a primary "signal" that is associated with a "receiver". The same circuit can simultaneously control the two signals.

The helmet according to the invention, will find its use in every field of application of a protective helmet.

I claim:

1. A safety helmet provided with an interlock signal, comprising:

a sensor that detects when said safety helmet has been placed on a user's head;

means for fastening said safety helmet to the user's head; and means for indicating whether said means for fastening is properly secured.

2. The safety helmet of claim 1, wherein said means for indicating is operative when said safety helmet is not properly secured.

3. The safety helmet of claim 2, wherein said means for indicating is disabled when said means for fastening is properly secured.

4. The safety helmet of claim 1, wherein said means for indicating comprise an electronic indicator.

5. The safety helmet of claim 4, wherein said electronic indicator comprise a sonorous source.

6. The safety helmet of claim 1, wherein said means for fastening comprise a chin strap, said chin strap controlling a switching means, and said switching means changing from a first state to a second state when a sufficient amount of tension is placed on said chin strap, with the state of said switching means controlling the operation of said means for indicating.

7. The safety helmet of claim 6, wherein said switching means comprises a mechanical switch.

8. A safety helmet provided with an interlock signal, comprising:

a sensor that detects when said safety helmet is placed on a user's head;

means for fastening said safety helmet to the user's head;

means for sensing that said safety helmet has been properly fastened; and means for indicating that said means for fastening is properly secured, said means for indicating being responsive to said sensing means.

9. The safety helmet of claim 8, wherein said sensing means comprise a switch, said means for fastening comprise a chin strap, and said switch is operative to control said means for indicating based on the tension in said chin strap.

10. The safety helmet of claim 9, wherein said means for indicating comprise a sonarous source.

* * * * *